United States Patent [19]

Parduhn

[11] Patent Number: 4,659,046

[45] Date of Patent: Apr. 21, 1987

[54] TRAFFIC CONTROL DEVICE MAST ARM BRACKET

[76] Inventor: A. Philip Parduhn, 14501 Wilson Rd., Edmond, Okla. 73013

[21] Appl. No.: 832,075

[22] Filed: Feb. 24, 1986

[51] Int. Cl.[4] ..... A47B 96/06

[52] U.S. Cl. ..... 248/231; 248/214; 248/219.4

[58] Field of Search ..... 248/214, 230, 231, 218.4, 248/219.3, 219.4, 225.31; 403/326

[56] References Cited

U.S. PATENT DOCUMENTS

| | | | |
|---|---|---|---|
| 2,124,006 | 7/1938 | Parker | 403/59 |
| 2,498,590 | 2/1950 | Straus | 403/326 |
| 2,942,366 | 4/1958 | Pfaff, Jr. et al. . | |
| 3,586,280 | 6/1971 | Parduhn . . | |
| 3,764,099 | 10/1973 | Parduhn | 248/214 |
| 3,854,685 | 12/1974 | Parduhn . | |
| 4,447,750 | 5/1984 | Howlett | 403/326 |

*Primary Examiner*—Reinaldo P. Machado
*Assistant Examiner*—Alvin Chin-Shue
*Attorney, Agent, or Firm*—Dunlap, Codding & Peterson

[57] ABSTRACT

A bracket particularly suited for securing a traffic light fixture to a horizontally extending mast arm which comprises two basic components telescopically interconnected by use of a snap ring and bolts for clamping the outer section to the inner section.

5 Claims, 5 Drawing Figures

TRAFFIC CONTROL DEVICE MAST ARM BRACKET

BRIEF SUMMARY OF THE INVENTION

1. Field of the Invention

This invention relates to improvements in brackets for securing traffic control devices to mast arms, and more particularly, but not by way of limitation, to an improved bracket for securing a signal light to a mast arm.

2. Background of the Invention

Generally speaking, traffic signal lights are secured to a horizontally extending mast arm by what may be basically considered a two-part bracket, one part of which is secured to a vertically extending member rigidly attached to the signal light fixture and the second part attached to the mast arm. Heretofore, the two parts have been threadedly interconnected to allow for adjusting the orientation of the signal light relative to the mast arm and to fairly rigidly interconnect the two parts to maintain the desired alignment, as by using a set screw between the two threaded sections. Such a threaded construction results in a relatively expensive bracket which is difficult to assemble and it has been found that the desired alignment of the traffic light fixture sometimes is not maintained, as when the fixture is subjected to high winds.

The present bracket basically comprises a two-part bracket assembly where the two parts are telescopically interconnected by a snap ring and then the outer component is clamped around the inner component to rigidly secure the two parts of the bracket in the desired relationship, resulting in an economical construction which is readily assembled and/or disassembled.

DETAILED DESCRIPTION OF THE DRAWINGS

Figure 1:
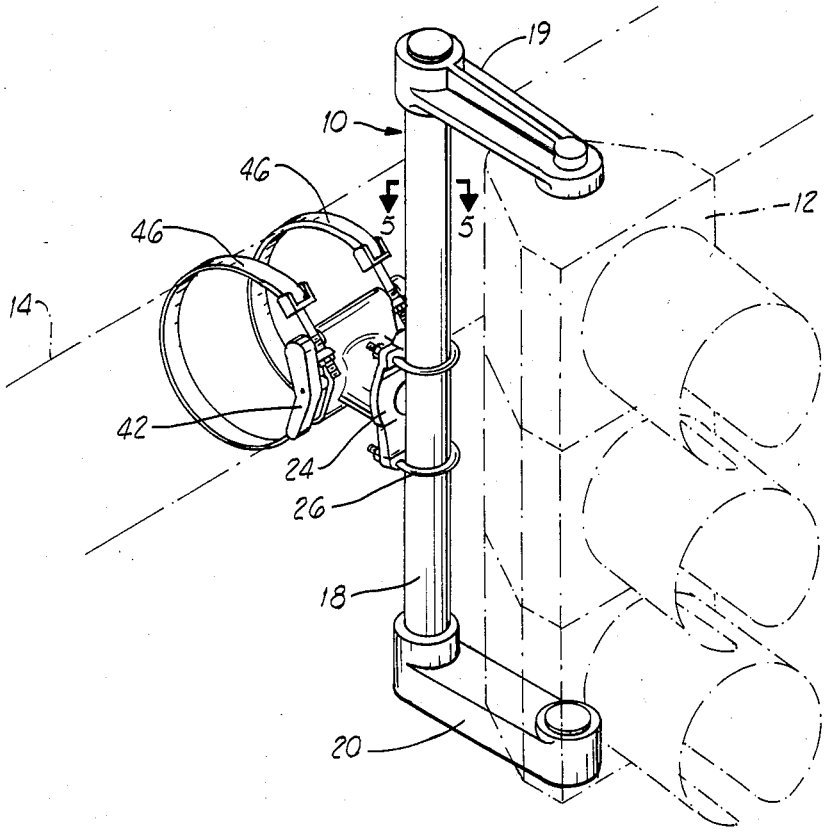
FIG. 1 is a perspective view of the bracket of the present invention illustrated as being employed to support a traffic light fixture on a horizontally extending mast arm.
Figure 5:
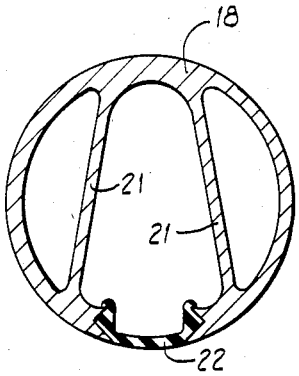
FIG. 5 is a sectional view taken along lines 5—5 of FIG. 1.

Referring to the drawings in detail, and particularly FIG. 1, reference character 10 generally designates a bracket constructed in accordance with this invention for supporting a traffic signal light fixture 12 in the desired position and at the desired orientation with respect to a horizontally extending mast arm 14. The bracket 10 comprises a vertically extending, elongated member 18 which is secured by arms 19 and 20 at its upper and lower ends to the top and bottom respectively of the light fixture 12. The elongated member 18 is preferably a tubular member having reinforcing gussetts 21 (see FIG. 5) formed therein to provide a lightweight, but strong member. Also, a plastic strip 22 slidingly fits in a mating groove formed in the side of the member 18 facing away from the light fixture 12 to facilitate the electrical connections necessary for the fixture.

A clamp plate 24 is secured to one side of the elongated member 18 by a pair of U-bolts 26. As shown in FIG. 4, the face 28 of the clamp plate 24 which faces the elongated member 18 has a vertical groove 30 therein such that the face 28 mates with one side of the elongated member 18. A tubular extension 32 extends from the clamp plate 24 in a direction opposite from the face 28. A groove 34 is formed in the outer periphery of the tubular extension 32 adjacent the end 36 of the tubular extension remote from the clamp plate 24 to receive a snap ring 38 for purposes to be described. The snap ring 38 is a split ring, as shown in FIG. 3, and apertured tabs 40 are formed on the free ends of the snap ring to facilitate the assembly of the snap ring into the groove 34.

Figure 2:
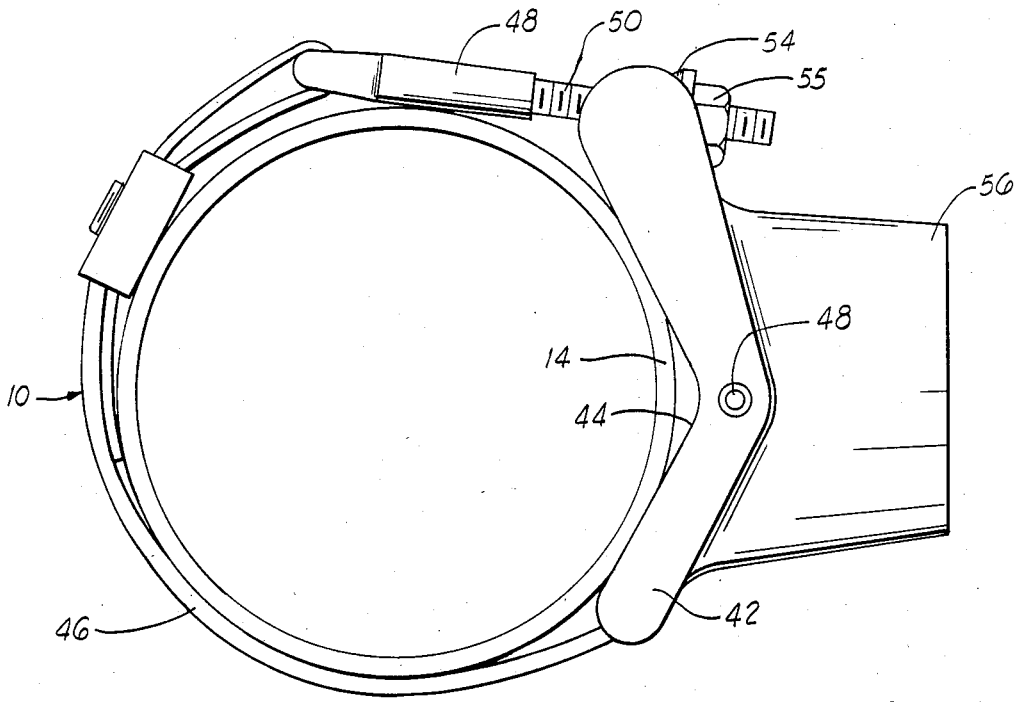
FIG. 2 is a side view of that portion of the bracket attached to the mast arm with the thickness of the attaching strap being exaggerated for clarity of illustration.

The bracket 10 (FIG. 2) further includes an anchor plate 42 having one face 44 thereof shaped to mate with a side of the mast arm 14. The anchor plate 42 is secured to the mast arm 14 by a pair of straps 46 each of which is suitably secured by a pin 48 to the anchor plate 42 at what is effectively one end portion of the strap. The opposite end portion of each strap 46 is secured to a threaded adjusting assembly 48 having a threaded section 50 which extends through a slot 52 (FIG. 3) in one edge of the anchor plate 42. An apertured fitting 54 is placed on each threaded section 50 and is shaped to engage the face of the anchor plate around the respective slot 52. Tightening of nuts 55 against the fittings 54 adjusts the tension of the straps 46 around the mast arm 14.

A tubular section 56 extends from the anchor plate 42 in the direction opposite the face 44 and, as shown in FIG. 4, the inner diameter of the tubular extension 56 is of a size to receive the tubular section 32 of the clamp plate 24. This fit may be described as a rather loose sliding fit in order that the rotary position of the clamp plate 24 may be readily adjusted with respect to the anchor plate 42. A counterbore 58 is formed in the face 44 of the anchor plate 42 to form a shoulder 60 facing away from the clamp plate 24. The sizes of the tubular extensions 32 and 56 are such that when the extensions are fully assembled with the snap ring 38 in position, the snap ring 38 will engage the shoulder 60 and retain the tubular extensions in assembly. It may also be noted that the apertured tabs 40 of the snap ring 38 are readily accessible through the counterbore 58, such that the snap ring can be readily installed or removed during the assembly or disassemby of the bracket.

Figure 3:
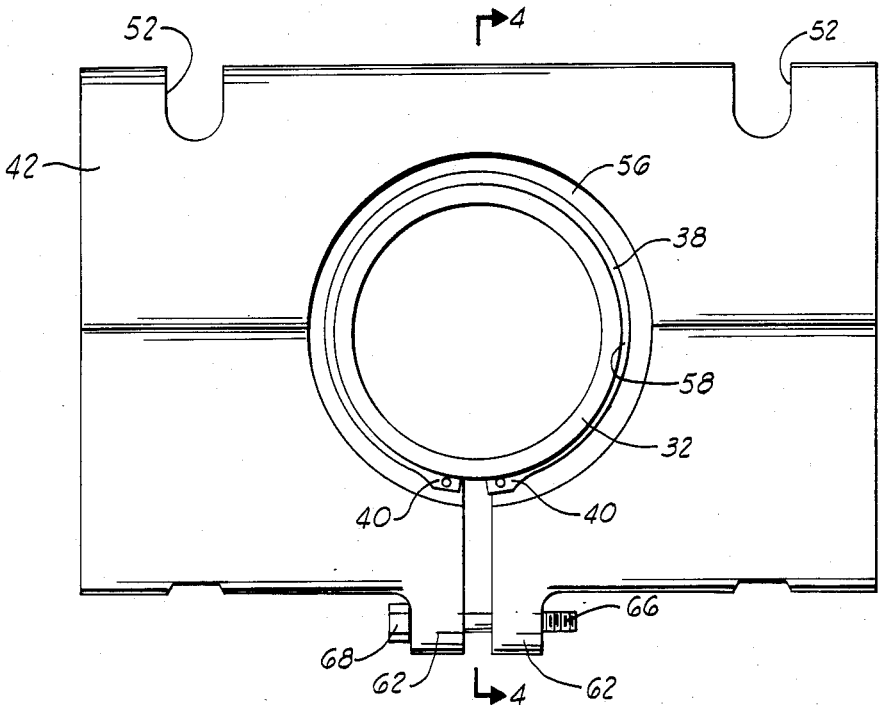
FIG. 3 is an end view of the bracket looking at the face of the bracket which mates with the mast arm.
Figure 4:
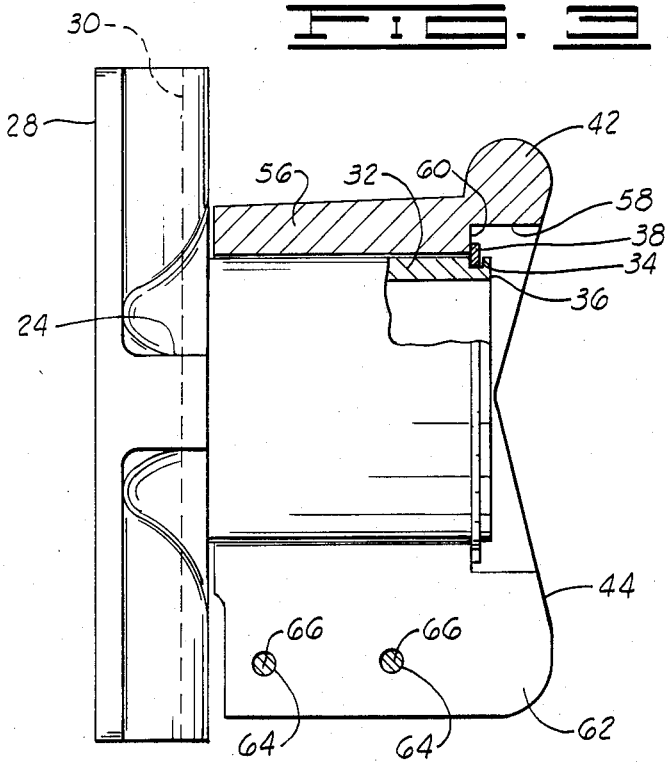
FIG. 4 is a sectional view taken along lines 4—4 of FIG. 3.

As shown in FIGS. 3 and 4, the anchor plate 42, along with the extension 56 are split lengthwise with respect to the extension 56. Tabs or extensions 62 are provided on the anchor plate 42 and the tubular extension 56 adjacent the split, and apertures 64 are provided through these tabs to receive bolts 66 having suitable heads 68 thereon. During assembly of the bracket, when the desired orientation of the traffic light fixture 12 with respect to the mast arm 14 is obtained by adjusting the clamp plate 24 with respect to the anchor plate 42, the bolts 66 are tightened to clamp the anchor plate tubular extension 56 around the clamp plate tubular extension 32, which will maintain the desired orientation.

Changes may be made in the combination and arrangement of parts or elements as heretofore set forth in the specification and shown in the drawings without departing from the spirit and scope of the invention as defined in the following claims.

What is claimed is:

1. A bracket for securing a traffic control device to a mast arm, comprising:

an elongated member;

means rigidly securing the elongated member to the traffic control device;

a clamp plate having one face shaped to mate with a side of the elongated member and having a tubular section extending from the opposite face thereof;

means for adjustably securing the claimp plate to the elongated member;

an anchor plate having one face shaped to mate with the mast arm and having a tubular section extending from the opposite face thereof split lengthwise and sized to be journaled on the tubular section of the clamp plate; said clamp and anchor plates each having a bore therethrough aligned with their respective tubular sections;

means for adjustably securing the anchor plate to the mast arm;

snap ring means for securing said tubular sections together; and means for clamping the tubular section of the anchor plate around the tubular section of the clamp plate.

2. A bracket as defined in claim 1 wherein the means for securing the clamp plate to the elongated member includes U-bolts sized to extend from the clamp plate around the elongated member.

3. A bracket as defined in claim 1 wherein the means for securing the anchor plate to a mast arm include flexible straps sized to extend around the mast arm and connect to the anchor plate.

4. A bracket as defined in claim 1 wherein the snap ring means comprises a groove in the outer periphery of the clamp plate tubular section, an annular shoulder on the anchor plate facing away from the clamp plate and located adjacent the side of the groove nearest the clamp plate, and a snap ring in the groove.

5. A bracket as defined in claim 4 wherein the annular shoulder is formed by a counterbore in the anchor plate extending from the face of the anchor plate shaped to mate with the mast arm, and wherein the snap ring is split and has apertured tabs on the opposite ends thereof accessible through said counterbore for assembly and disassembly of the snap ring.

* * * * *